US006477743B1

(12) United States Patent
Gross et al.

(10) Patent No.: US 6,477,743 B1
(45) Date of Patent: Nov. 12, 2002

(54) TWIST-OPENABLE DISPENSING CLOSURE ACCOMMODATING OPTIONAL LINER PUNCTURE FEATURE

(75) Inventors: Richard A. Gross, Oconomowoc, WI (US); Walter W. Peterson, Littleton, CO (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/929,389

(22) Filed: Aug. 14, 2001

(51) Int. Cl.[7] ..... B65D 35/00

(52) U.S. Cl. ..... 22/525; 222/83; 222/212; 222/499

(58) Field of Search ..... 222/83, 83.5, 88, 222/212, 499, 519, 520, 525

(56) References Cited

U.S. PATENT DOCUMENTS

| | | | | |
|---|---|---|---|---|
| 2,998,170 A | * | 8/1961 | Manzione et al. | 222/520 |
| 3,406,872 A | | 10/1968 | Fiquet et al. | |
| 3,580,423 A | | 5/1971 | Gilman | |
| 4,234,103 A | | 11/1980 | Strohl, Jr. et al. | |
| 4,234,104 A | | 11/1980 | Apuzzo, Jr. et al. | |
| 4,307,821 A | | 12/1981 | McIntosh | |
| 4,771,919 A | * | 9/1988 | Ernst | 222/525 |
| 5,139,182 A | | 8/1992 | Appla | |
| 5,431,305 A | | 7/1995 | Kaminski | |
| 5,482,176 A | | 1/1996 | Maietta et al. | |
| 5,566,859 A | | 10/1996 | Willis et al. | |
| 5,680,969 A | | 10/1997 | Gross | |
| 5,692,651 A | | 12/1997 | Fuchs | |
| 5,810,185 A | * | 9/1998 | Groesbeck | 222/499 |
| 5,853,109 A | | 12/1998 | Elliot | |
| 5,938,086 A | | 8/1999 | Gross | |
| 5,992,668 A | | 11/1999 | Elliott | |
| 6,039,198 A | | 3/2000 | Wolfe | |
| 6,045,004 A | | 4/2000 | Elliott | |
| 6,056,142 A | | 5/2000 | Elliott | |

FOREIGN PATENT DOCUMENTS

| | | |
|---|---|---|
| EP | 296100 B1 | 4/1993 |
| EP | 473678 B1 | 11/1994 |
| WO | WO 01/05674 A1 | 1/2001 |

OTHER PUBLICATIONS

U.S. Patent Application Ser. No. 09/550,279, filed Apr. 14, 2000.

U.S. Patent Application Ser. No. 09/791, 075, filed Feb. 22, 2001.

* cited by examiner

*Primary Examiner*—J. Casimer Jacyna
(74) *Attorney, Agent, or Firm*—Wood, Phillips, Katz, Clark & Mortimer

(57) ABSTRACT

A dispensing closure system is provided for a container. The system includes a body for extending from the container at the container opening. The body includes a base, a conduit that is reciprocatable relative to the base, and a flexible wall joining the conduit to the base. The conduit includes a dispensing aperture and a first seal surface. A spout is carried on, and is rotatable relative to, the body. The spout includes a dispensing orifice and a second seal surface for engaging the first seal surface. The body and spout together define a rotary-to-linear motion translation drive system that is (1) responsive to the rotation of the spout in one direction for moving the conduit in a first direction to a closed position, and (2) responsive to the rotation of the spout in the opposite direction for moving the conduit in a second direction opposite from the first direction to an open position.

20 Claims, 3 Drawing Sheets

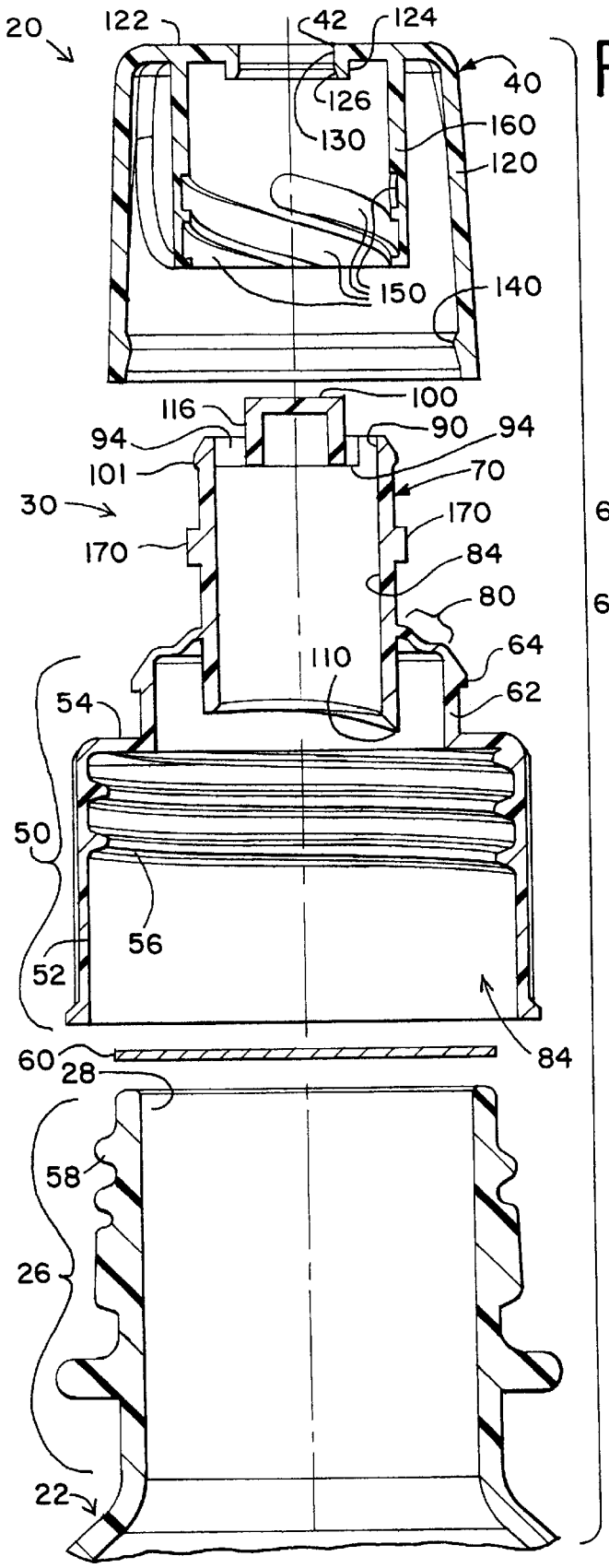
FIG. 5
FIG. 6
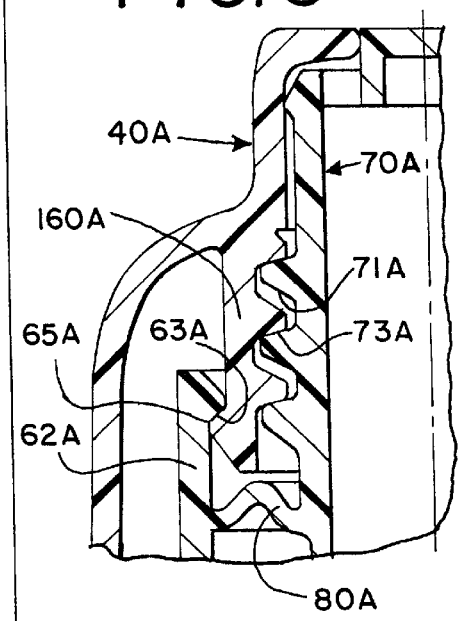
FIG. 7
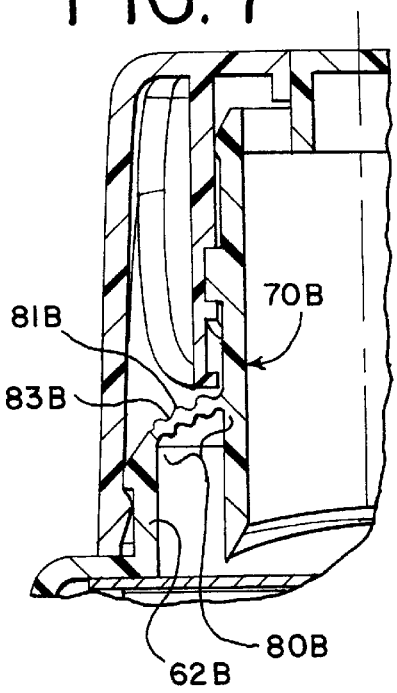

TWIST-OPENABLE DISPENSING CLOSURE ACCOMMODATING OPTIONAL LINER PUNCTURE FEATURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a fluent material from a container. The invention is particularly suitable for incorporation in a dispensing closure for use with a squeezable container.

BACKGROUND OF THE INVENTION AND TECHNICAL PROBLEMS POSED BY THE PRIOR ART

There are a variety of types of conventional dispensing closures which function generally satisfactorily in applications for which they are designed. One type of prior art dispensing closure system includes a body or base for being attached to the top of a container and includes a rotatable spout which is mounted on the base or body. Rotation of the spout in one direction raises the spout slightly to open a dispensing aperture in the base or body. Rotation of the spout in the opposite direction lowers the spout to close the dispensing aperture. See, for example, the design disclosed in the U.S. Pat. No. 5,680,969.

While such a prior art twist-to-open/twist-to-close device functions well in the applications for which it is intended, users of the device in other applications might find one aspect of the device has a somewhat diminished aesthetic appeal. In particular, the spout rises upwardly along the base or body as the spout is rotated upwardly to the full open position, and this creates a gap beneath the lower edge of the rising spout along body or base. This gap region might be regarded by some users as unsightly. Also, if the dispensing closure is intended to be used with bottled water products, sports drink products, etc., which the user may wish to consume by inserting the dispensing closure into the user's mouth, then the gap might feel somewhat uncomfortable if the user's lips become located around the gap.

Thus, it would be desirable to provide a dispensing closure system which would permit the user to rotate a spout component for effecting opening of the dispensing orifice without creating a gap adjacent the spout.

It would also be desirable to provide a dispensing closure system which would have a minimum number of components so as to facilitate manufacture and assembly.

It would also be advantageous to provide a dispensing closure system which would have a capability for optionally accommodating the use of a puncturable or severable liner or membrane sealed across the dispensing passage. For example, some conventional packages are provided with a liner across the bottom of the closure or across the top of the container neck. See, for example, U.S. Pat. Nos. 6,045,004 and 5,853,109 which discloses a liner or membrane disposed across, and sealed to, the top of a container opening so that the liner can be pierced or punctured by initially pushing a closure top member downwardly. It would be desirable to provide a twist-to-open/twist-to-close dispensing closure with an analogous, but optional, capability for incorporating such a liner and for puncturing the liner by manipulating the closure system without having to remove the closure system from the container.

It would also be advantageous to provide a dispensing closure system with the capability for accommodating optional tamper-evident features that can readily indicate to a consumer that the dispensing closure system has been initially opened or tampered with.

Further, it would be beneficial if an improved dispensing closure system could optionally accommodate the use of an overcap to protect the dispensing spout prior to use.

It would also be beneficial if a dispensing closure system could readily accommodate its manufacture from a variety of different materials.

It would also be advantageous if such an improved closure system could accommodate bottles, containers, or packages which have a variety of shapes and which are constructed from a variety of materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The present invention provides an improved dispensing closure system for a container that has an opening to the container interior. The user can easily operate the closure system to assume a closed configuration for preventing flow from the container or to assume an open configuration for permitting flow from the container.

The dispensing closure system, when it is in either the open configuration or the closed configuration, does not have an unsightly gap along the side of the system or container The system therefore minimizes the existence of open regions or features which might accumulate unwanted product or dirt, and the system also minimizes edges or gaps which might be uncomfortable to a user's fingers or lips.

The dispensing closure system of the present invention can optionally accommodate tamper-evident features, pierceable membrane or liner features, and overcaps.

The dispensing closure system includes a body for extending from the container at the container opening. The body includes (a) a base, (b) a conduit that is reciprocatable relative to the base, and (c) a flexible wall that joints the conduit to the base. The conduit includes a discharge aperture and a first seal surface.

The dispensing closure system includes a spout that is carried on, and that is rotatable relative to, the body. The spout includes a dispensing orifice and a second seal surface for engaging the first seal surface.

The body and spout together define a rotary-to-linear motion translation drive system. The drive system is responsive to the rotation of the spout in one direction for moving the conduit in a first direction to a closed position in which the first and second sealing surfaces are in sealing engagement to occlude the spout dispensing orifice. The drive system is also responsive to the rotation of the spout in the opposite direction for moving the conduit in a second direction opposite from the first direction to an open position in which the conduit first seal surface is spaced from the spout second seal surface to permit flow from the conduit discharge aperture through the spout dispensing orifice.

The closure system can be readily incorporated as a separate assembly of components defining a closure that is separate from, but which is adapted to be mounted to, the container. Such a closure may be incorporated in an embodiment which is removably attachable to the container or which is non-removably attachable to the container.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 5 is a view similar to FIG. 4, but FIG. 5 shows the components exploded away from each other;

FIG. 6 is a fragmentary, cross-sectional view similar to FIG. 3, but FIG. 6 shows a second embodiment of the dispensing closure system of the present invention; and FIG. 7 is a fragmentary, cross-sectional view similar to FIG. 3, but FIG. 7 shows a third embodiment of the dispensing closure system of the present invention.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing closure system in the typical orientation that it would have at the top of a container when the container is stored upright on its base, and terms such as upper, lower, horizontal, etc., are used with reference to this position. It will be understood, however, that the dispensing closure system of this invention may be manufactured, stored, transported, used, and sold in an orientation other than the position described.

The dispensing closure system of this invention is suitable for use with a variety of conventional or special containers having various designs, the details of which, although not illustrated or described, would be apparent to those having skill in the art and an understanding of such containers. The container per se described herein forms no part of and therefore is not intended to limit the present invention. It will also be understood by those of ordinary skill that novel and non-obvious inventive aspects are embodied in the described exemplary closure systems alone.

Figure 1:
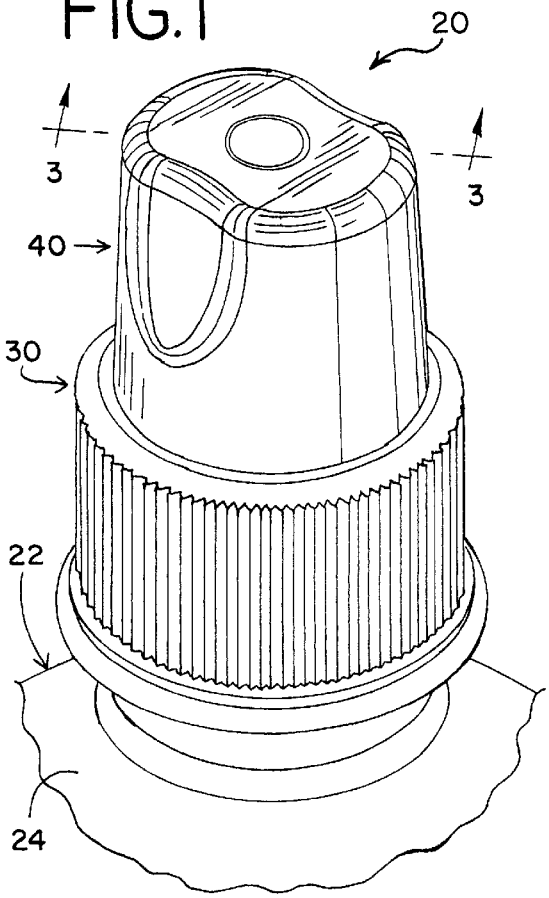
FIG. 1 is a fragmentary, perspective view of an exemplary dispensing closure system in the form of a separate dispensing closure according to a preferred embodiment of the invention, and the closure is shown in a closed configuration on a container and from a vantage point generally above, or from the top of, the closure.
Figure 2:
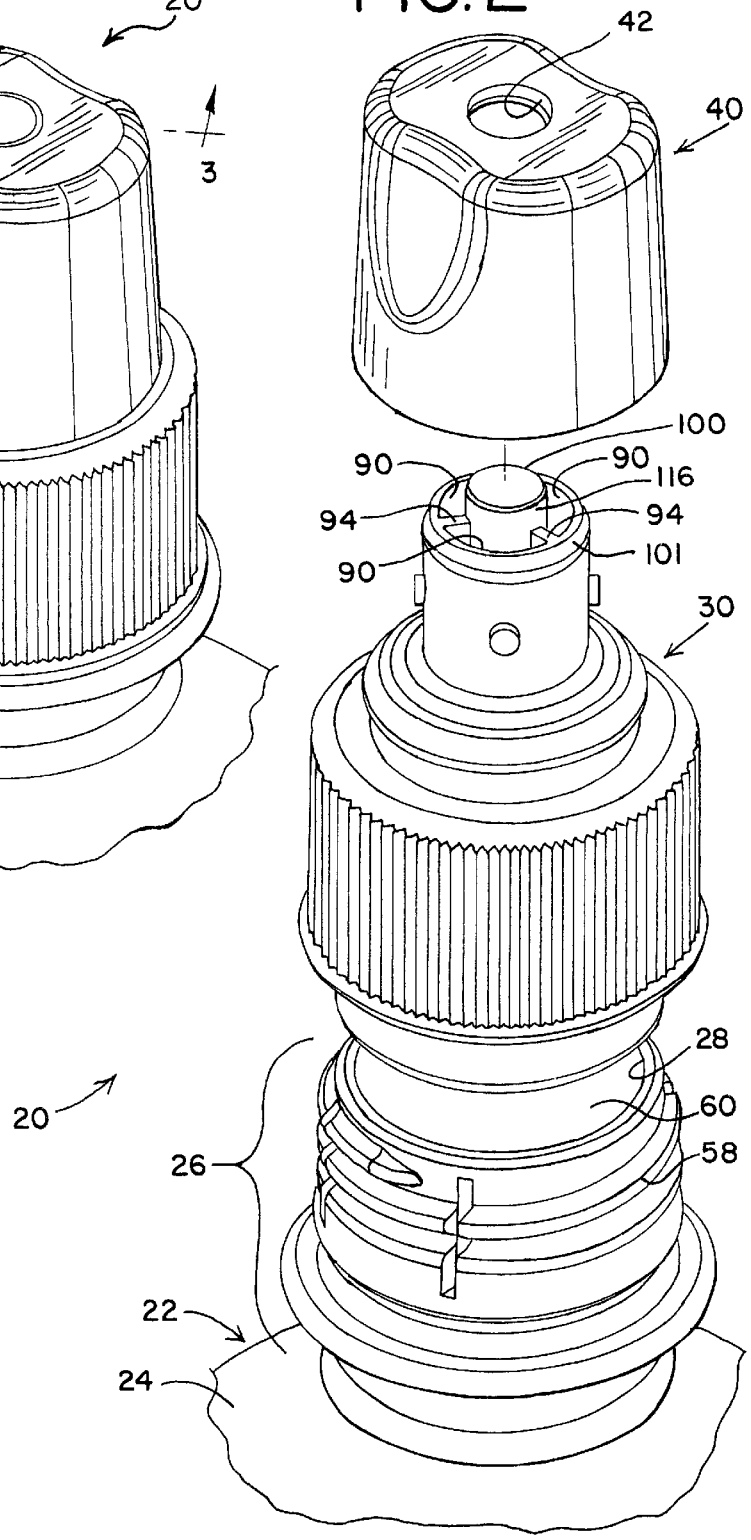
FIG. 2 is an exploded, perspective view of the closure illustrated in FIG. 1.

A presently preferred embodiment of a dispensing structure or dispensing closure system of the present invention is illustrated in FIGS. 1–5 and is designated generally therein by reference number 20 in FIG. 1. In the preferred embodiment illustrated, the dispensing structure or dispensing closure system 20 is provided in the form of a closure 20 which is adapted to be mounted on a container 22 that would typically contain a fluent material. The container 22 includes body 24 and a neck 26 as shown in FIG. 2. The neck 26 defines an opening 28 to the container interior. The container neck 26, in the preferred embodiment illustrated in FIG. 2, has an external, male thread 58 for engaging the closure 20.

The body 24 of the container 22 may have any suitable configuration, and the upwardly projecting neck 26 may have a different cross-sectional size and/or shape than the container body 24. Alternatively, the container 22 need not have a neck 26 per se. Instead, the container 22 may consist of just a body with an opening. The container 22 may have a rigid wall or walls, or may have a somewhat flexible wall or walls.

Although the container, per se, does not necessarily form a part of the broadest aspects of the present invention, per se, it will be appreciated that at least a body portion of the dispensing structure or system 20 of the present invention may be provided as a unitary portion, or extension, of the top of the container. However, in the preferred embodiment illustrated, the dispensing system 20 is a separate element (e.g., a closure) which is adapted to be removably or non-removably mounted to a previously manufactured container 20 which has an opening 28 to the container interior.

The closure 20 is adapted to be used with a container 22 having an opening 28 to provide access to the container interior and to a product contained therein. The closure 20 can be used with many materials, including, but not limited to, relatively low or high viscosity liquids, creams, gels, suspensions, mixtures, lotions, pastes, particulates, granular materials, etc. as constituting a food product, a personal care product, an industrial or household cleaning product, or other compositions of matter (e.g., compositions for use in activities involving manufacturing, commercial or household maintenance, construction, agriculture, etc.).

The container 22 with which the closure 20 may be used would typically be a squeezable container having a flexible wall or walls which can be grasped by the user and squeezed or compressed to increase the internal pressure within the container so as to force the product out of the container and through the closure. Such a flexible container wall typically has sufficient, inherent resiliency so that when the squeezing forces are removed, the container wall returns to its normal, unstressed shape. Such a squeezable wall container is preferred in many applications but may not be necessary or preferred in other applications. For example, in some applications it may be desirable to employ a generally rigid container, and to pressurize the container interior at selected times with a piston or other pressurizing system.

It is presently contemplated that many applications employing the closure 20 will be most conveniently realized by molding some or all of the components of the closure 20 from a suitable thermoplastic and/or thermoset material or materials. In the preferred embodiment illustrated, the components of the closure could each be molded from a suitable thermoplastic material, such as polypropylene. The closure components may be separately molded from the same material or from different materials. The materials may have the same or different colors and textures.

As can be seen in FIG. 2, the closure system 20 includes two basic components, (1) a body 30, and (2) a spout 40 which is adapted to be carried on the body 30 and which is rotatable relative to the body 30.

As can be seen in FIG. 5, the closure body 30 includes a base portion or base 50 which comprises a skirt 52 and an inwardly extending, generally annular deck 54. The interior surface of the skirt 52 defines a female thread 56 for threadingly engaging the exterior, male thread 58 on the container neck 26.

Alternatively, the closure skirt 52 could be provided with some other container connecting means, such as a snap-fit bead or groove (not illustrated) in place of the thread 56 for engaging a container groove or bead (not illustrated), respectively, in the container neck. The closure body 30 could also be permanently attached to the container 22 by means of induction melting, ultrasonic melting, gluing, or the like, depending on materials used for the closure body 30 and container 22. The closure body 30 could also be formed as a unitary part, or extension, of the container 22.

The closure body skirt 52 may have any suitable configuration for accommodating an upwardly projecting neck 26 or other portion of the container 22 received within the particular configuration of the closure body 30, and the main part of the container 22 may have a different cross-sectional shape than the container neck 26 and closure body 30.

An optional seal or liner 60 may be sealed across the top of the container neck 26 or, alternatively, to the underside of the closure body deck 54. However, if a tamper-evident seal or freshness seal as provided by such a liner 60 is not needed or desired in a particular application, then the liner 60 may, of course, be omitted.

Also, if desired, the closure body 30 may be provided with an annular seal (not illustrated) extending downwardly from the underside of the closure body deck 54. Such a seal could be "crab's claw" profile seal, a plug seal, or some other such seal, depending upon the particular application and depending upon whether or not a liner 60 is employed.

With continued reference to FIG. 5, the closure body base 50 includes a reduced diameter, annular wall 62. At the upper end of the wall 62 there is an outwardly extending lip 64. In an alternate embodiment, not illustrated, no reduced diameter wall 62 need be employed. The closure body base 50 may instead include a continuation of the upper portion of the skirt 52 which would extend upwardly above the thread 56 at the same diameter as the portion of the skirt 52 below the thread 56. Indeed, the portion of the base 50 above the thread 56 could even have a diameter greater than the portion of the skirt 52 at or below the thread 56.

As shown in FIG. 5, the closure body 30 includes a chimney or conduit 70 connected to the closure body base 50 by means of an intermediate, generally annular, flexible wall 80. The wall 80 extends around the periphery of the conduit 70 so as to provide a completely sealed region between the closure body base 50 and the exterior of the lower portion of the conduit 70. The flexible wall 80 accommodates vertical movement or reciprocation of the conduit 70 relative to the closure body base 50 (and relative to the container 22 when the closure body base 50 is mounted on the container 22).

In the preferred form of the invention illustrated, the closure body base 50 has a generally annular configuration, the flexible wall 80 has a generally frustoconical or annular configuration, and the conduit 70 has a generally annular configuration. However, these portions or elements of the closure body 30 may have other configurations. For example, the closure body base 50 might have a prism or polygon configuration adapted to be mounted to the top of a container neck having a polygon configuration. Such prism or polygon configurations would not accommodate the use of a threaded attachment, but other means of attachment could be provided, such as a snap-fit bead and groove arrangement, or the like.

The conduit 70, in the preferred embodiment illustrated, is adapted to accommodate rotation of the spout 40 as described in detail hereinafter. To this end, in the preferred embodiment of the conduit 70 illustrated, the conduit 70 generally has an annular configuration to accommodate rotation of the spout 40 thereon. However, in alternate embodiments (not illustrated) a substantial portion of the conduit 70 need not be annular and could instead have other configurations such as polygon or prism configurations, so long as at least a portion of the conduit 70 can interact with the spout 40 as part of a rotary-to-linear motion translation drive system, a form of which is described in detail hereinafter.

The conduit 70 defines an internal discharge passage 84 which is open at the bottom to the interior region defined by the hollow closure body base 50. Together, the hollow body base 50 and conduit 70 may be characterized as defining a discharge passage extending from one end of the closure body 30 to the other end of the closure body 30. When the closure body 30 is mounted on the container neck 26 (FIG. 4), the discharge passage may be regarded as extending at least from the upper end or opening of the container neck 26 through the closure body 30 to the upper end of the closure body 30.

The upper end of the closure body 30 is defined by the upper end of the conduit 70 which has a discharge aperture or apertures 90 (FIG. 2). As can be seen in FIG. 2, in the preferred embodiment, there are three arcuate discharge apertures 90 which are defined between three, inwardly extending, supporting walls or ribs 94 (two of which ribs 94 are visible in FIG. 2). The inwardly extending ribs 94 support a central plug 100 as shown in FIGS. 2 and 5. The conduit plug 100 includes a generally cylindrical exterior first seal surface 116 as can be seen in FIGS. 2 and 5.

Extending radially outwardly around the apertures 90 and ribs 94 is an annular bead defining a sliding seal 101 (FIG. 2) for sealingly engaging the spout 40 as described in detail hereinafter.

The bottom end of the conduit 70, in the preferred embodiment illustrated in FIG. 5, has a sharp bottom edge with a portion of the circumference extending downwardly somewhat further than the rest of the circumference of the bottom end to define a point or piercing region 110.

The spout 40 includes a skirt 120 and an annular top deck 122 which defines a dispensing orifice 42 (FIG. 5). Extending downwardly from the underside of the top deck 122 is an annular collar 124. The inside surface of the annular collar 124 is angled outwardly slightly to define a tapered surface 126 as can be seen in FIG. 5. A substantially cylindrical, second seal surface 130 extends upwardly from the tapered surface 126 and defines the inside surface of the dispensing orifice 42. The spout second seal surface 130 is adapted to sealingly engage, or be sealingly engaged by, the conduit plug first seal surface 116 as illustrated in FIG. 3.

As illustrated in FIG. 5, the spout skirt 120 includes, at its lower end, a radially inwardly extending snap bead 140. As illustrated in FIG. 3, the spout skirt snap bead 140 is adapted to snap below, and engage, the radially outwardly extending closure body lip 64. The spout skirt 120 has sufficient flexibility and resiliency to temporarily accommodate the circumferentially outward deflection or expansion of the skirt 120 by an amount sufficient to allow the skirt bead 140 to pass over, and then snap inwardly below, the closure body lip 64. To facilitate this installation process and engagement, the upper portion of the closure body lip 64 is slanted or tapered, and the spout skirt bead 140 has a similarly oriented slant or taper.

The closure body 30 and the spout 40 together define a rotary-to-linear motion translation drive system which, in the preferred embodiment illustrated in FIGS. 1–5, includes four, generally helical cam grooves or tracks 150 (FIG. 5) defined in the inside surface of a wall 160 depending downwardly from the underside of the spout deck 122, and four cams or cam follower members 170 (FIG. 5) projecting radially outwardly from the exterior surface of the conduit 70. Each cam 170 is adapted to be received in one of the four cam tracks 150.

Figure 3:
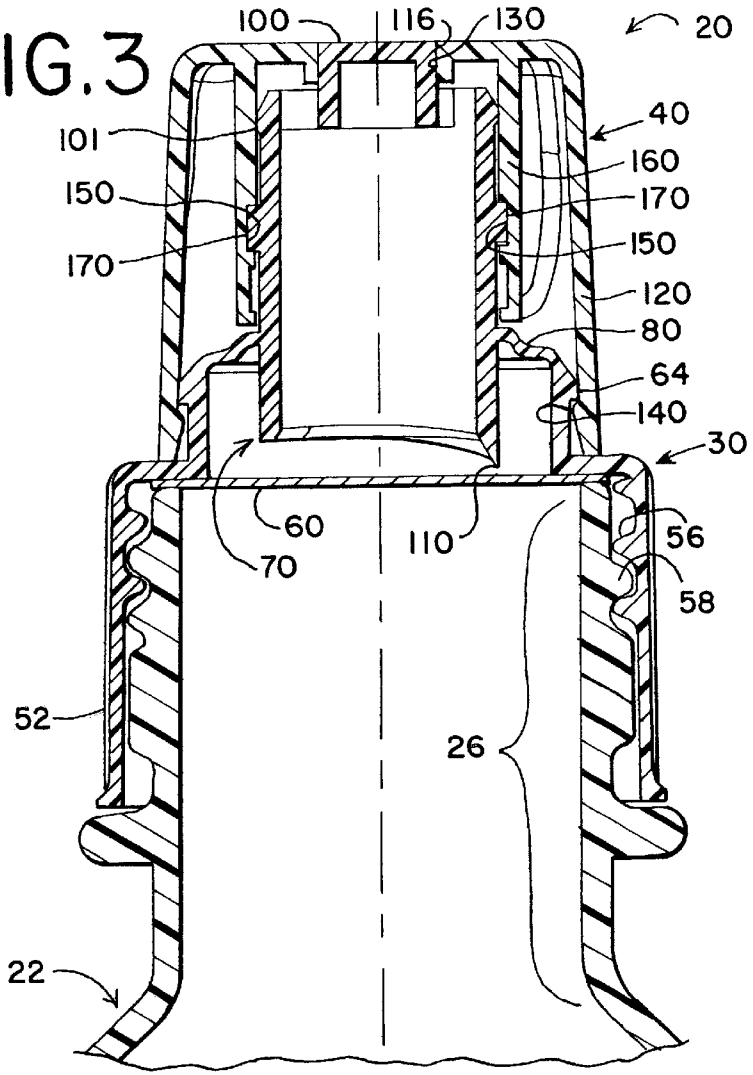
FIG. 3 is a fragmentary, cross-sectional view taken generally along the plane 3—3 in FIG. 1.

As shown in FIG. 3, the spout 40 can be initially threaded onto the cams 170 until the spout skirt snap bead 140 snaps under the closure body lip 64 and the spout dispensing orifice is occluded by the conduit plug 100 such that the conduit first seal surface 116 is sealingly engaged with the spout second seal surface 130 (FIG. 3).

When it is desired to open the container 22, the spout 40 can be rotated in one direction (counterclockwise as viewed in FIG. 1). Because the spout 40 is maintained at a fixed elevation on the closure body 30 by means of the engagement between the lip 64 of closure body 30 and the spout skirt bead 140, the spout 40 merely rotates without undergoing any translation or axial movement. The spout rotation torque is transferred to the conduit 70 as an axial force through the cam tracks 150 engaged with the conduit cams 170, and this causes the conduit 70 to move downwardly from the elevated, closed position illustrated in FIG. 3 to the lowered, open position illustrated in FIG. 4. As the conduit 70 moves downwardly, the annular flexible wall 80 deforms or deflects as necessary to accommodate the downward movement, and the piercing portion 110 of the conduit 70 pierces the liner 60 (if the optional liner 60 is provided in the package). The downward movement of the conduit 70 cuts a flap 190 of the liner 60 and forces it downwardly so that the flap hangs generally vertically downwardly from a small, unsevered portion located about 180 degrees from the conduit bottom edge point 110.

Figure 4:
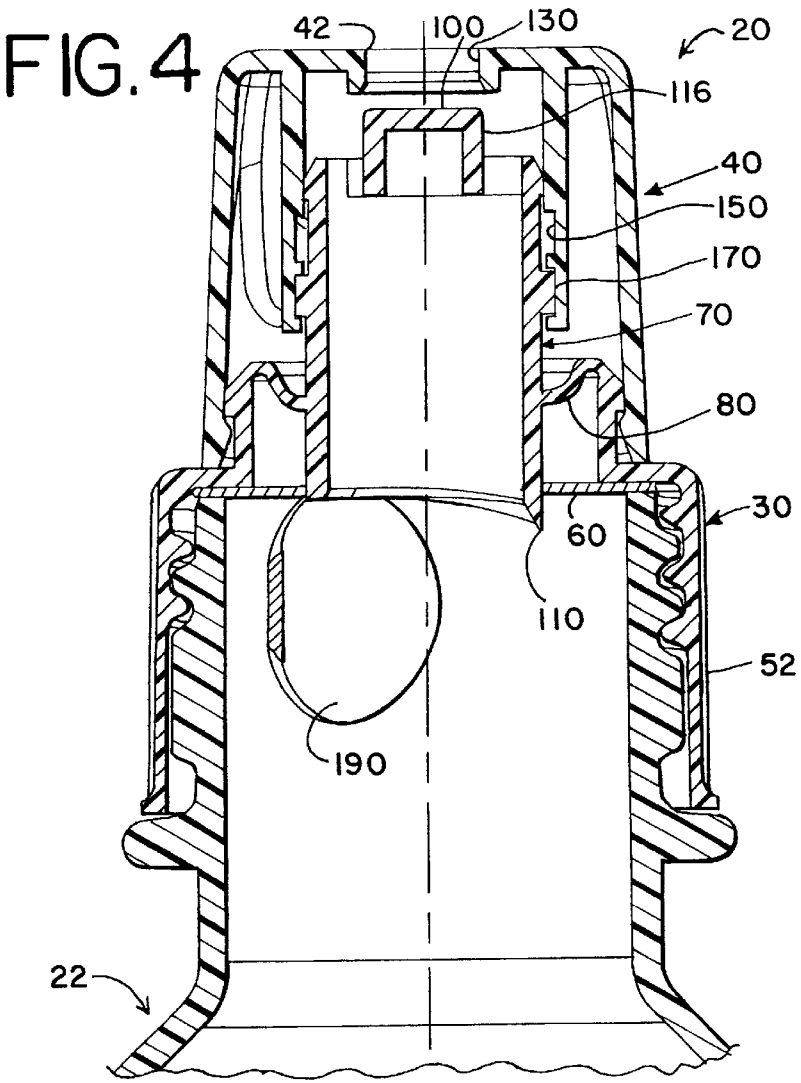
FIG. 4 is a view similar to FIG. 3, but FIG. 4 shows the closure after it has been operated to orient the closure in the open configuration.

The downward movement of the conduit 70 is terminated when the flexible wall 80 reaches the limit of its downwardly, deformed orientation as shown in FIG. 4. An attempt by the user to rotate the spout 40 any further in an opening direction (counterclockwise direction in FIG. 1) to move the conduit 70 further downwardly encounters the resistance or restraint imposed upon the conduit 70 by the deformed flexible wall 80, and the user finds it impossible to continue to rotate the spout 40 in the opening direction. This provides a tactile indication to the user that the liner 60 has been properly pierced and/or that the closure 20 is in a fully open condition as shown in FIG. 4.

When the closure 20 is in the full open condition as shown in FIG. 4, the user can tip or invert the package to facilitate the dispensing of fluent product under the influence of gravity. If the container 22 has a flexible wall or walls, the container 22 can be squeezed to further assist in dispensing the product.

After the desired amount of product has been dispensed, the package can be turned back to its upright orientation, and the user can rotate the spout 40 in a clockwise direction (as viewed in FIG. 1) to drive the conduit 70 upwardly to the fully closed position as shown in FIG. 3.

When the closure 20 is in the fully closed condition, as shown in FIG. 3, the flexible wall 80 has moved back to its upwardly angled orientation, and the further upward movement of the conduit 70 is prevented by the cams 170 butting the upper ends of the cam-receiving grooves 150. Thus, the user cannot rotate the spout 40 any further in the clockwise direction.

With reference to FIGS. 3 and 4, it will be appreciated that the spout 40 remains in the same axial position or at the same elevation relative to the closure body 30 at all times. Further, the closure body skirt 52 remains at the same elevation or fixed position relative to the container 22 and to the spout 40. The operation of the closure 20, by rotating the spout 40 to open or close the closure, does not create any gaps.

The inner surface of the spout inner wall 160 above the helical cam grooves 150 is in sealing contact with the closure body upper end seal bead 101 as shown in FIG. 3. This provides a continuously sealed dispensing passageway defined by the interior of the spout wall 160 and conduit 70 during the opening (and closing) of the system as the conduit 70 moves up and down.

It will be appreciated that the liner 60 need not be employed. If a liner 60 is not employed, the conduit 70 need not have a sharp, cutting bottom edge and may terminate at (i.e., not extend below) the flexible wall 80.

In an alternate embodiment illustrated in FIG. 6, a closure spout 40A is internally snap-fit to an upwardly projecting annular wall 62A of a closure body. To this end, the closure body wall 62A defines a radially inwardly extending annular bead 63A, and the spout 40A defmes a downwardly extending collar 160A with the radially outwardly extending annular bead 65A for engaging the bead 63A in a snap-fit engagement.

The conduit 70A is connected to the closure body wall 62A with a flexible wall 80A. Also, the exterior surface of the conduit 70A includes thread 71A for engaging a thread 73A on the inside of the spout wall 160A. The threaded engagement between threads 71A and 73A functionally replace the cam track and cam follower arrangement described above with reference to the first embodiment illustrated in FIGS. 1–5. Other aspects of the second embodiment illustrated in FIG. 6 may be substantially the same or similar to the corresponding features in the first embodiment illustrated in FIGS. 1–5.

FIG. 7 illustrates a third embodiment of a closure system in which a spout 40B surrounds a cam driven conduit 70B that is connected to a closure body wall 62B with a flexible wall 80B. The flexible wall 80B includes thickened ring sections 81B and thin groove or web sections 83B. The configuration of the wall 80B can provide enhanced translational flexibility while maintaining annular stability when the spout 40B is rotated to open or close the system. The other features of the third embodiment closure are substantially the same as corresponding features in the first embodiment described above with reference to FIGS. 1–5.

It will also be appreciated that the dispensing closure system 20 of this invention can be readily designed to incorporate appropriate tamper-evident features and/or child-resistant features. Such features may be incorporated within the structure of the closure body and/or may include overcap structures or shrink film systems (not illustrated). For example, it will be appreciated that, if desired, a tamper-evident band (not illustrated) may be employed between the closure body 30 and the container 22. Such a tamper-evident band could hang by frangible connections from the bottom edge of the closure body skirt and have a turned up bottom edge for engaging an underside of a flange on the container.

The closure body 30 may also be non-removably attached to the container, regardless of whether or not a tamper-evident band is employed.

Further, if desired, an overcap (not illustrated) may be mounted on the closure body 30 to cover and protect the closure spout 40. Such an overcap may be an entirely separate component, or such an overcap may be tethered to the closure body 30 with an appropriate hinge or strap.

The closure body, such as the body 30 illustrated in FIG. 5, may be bi-injection molded so that a different, more flexible material can be used for the flexible wall 80 compared to less flexible material used for the rest of the closure body 30.

It will also be appreciated that the dispensing system of the present invention need not be provided as a separate closure for a container. The closure body 30 could instead be molded as a unitary part of the container 22. A container could be molded to have (1) an initially open bottom end, (2) a peripheral wall forming an upper end that defines a container top end opening, and (3) a unitary closure body portion extending radially inwardly from the container peripheral wall over the container top end opening so as to form a unitary part of the container top end and so as to define the top end closure body wall 62, flexible wall 80, and conduit 70. The spout 40 could then be installed to close the closure. Then, the container could be filled with product through the open bottom end, and the open bottom end could be subsequently sealed closed by appropriate means, such as with thermally assisted deformation or with a separate bottom closure plug or cap.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure system for a container that has an opening to the container interior, said dispensing closure system comprising:

a body for extending from said container at said opening, said body including (a) a base, (b) a conduit that is reciprocatable relative to said base, and (c) a flexible wall joining said conduit to said base, said conduit including a discharge aperture, a first seal surface, and a sliding seal bead; and a spout that is carried on, and rotatable relative to, said body and that includes at least one dispensing orifice, a second seal surface for engaging said first seal surface when said conduit is at a predetermined position relative to said base, and a third seal surface for continuously engaging said conduit sliding seal bead;

said body and spout together defining a rotary-to-linear motion translation drive system that includes a cam track groove on said spout and a cam follower on said conduit for being received in said cam track groove whereby (1) rotation of said spout in one direction moves said conduit in a first direction to a closed position in which said first and second sealing surfaces are in sealing engagement to occlude said spout dispensing orifice, and (2) rotation of said spout in the opposite direction moves said conduit in a second direction opposite from said first direction to an open position in which said conduit first seal surface is spaced from said spout second seal surface to permit flow from said conduit discharge aperture through said spout dispensing orifice, said flexible wall temporarily deforming as said conduit moves between said first and second positions, said flexible wall preventing movement of said conduit in said second direction beyond said open position.

2. The dispensing closure system in accordance with claim 1 in which said system is a closure for an end of said container wherein the container end defines said container opening; and said closure includes said body and said spout.

3. The dispensing closure system in accordance with claim 2 in which said closure is an article that is separate from said container; and said body is removably attachable to said container end over said container opening.

4. The dispensing closure system in accordance with claim 1 in which said spout includes a cutting edge for cutting at least partially through a sealed liner which must be breached to afford access to the container opening.

5. The dispensing closure system in accordance with claim 1 in which said conduit has (1) a generally annular wall, and (2) a central plug supported by a plurality of ribs extending radially inwardly from said annular wall whereby said at least one dispensing orifice is defined between two of said ribs, said plug, and said annular wall.

6. The dispensing closure system in accordance with claim 5 in which said first seal surface is defined on a peripheral surface region of said plug.

7. The dispensing closure system in accordance with claim 1 in which said second seal surface is a generally interior cylindrical surface.

8. A dispensing closure system for a container that has an opening to the container interior, said dispensing closure system comprising:

a body for extending from said container at said opening, said body including (a) a base, (b) a conduit that is reciprocatable relative to said base, and (c) a flexible wall joining said conduit to said base, said conduit including a discharge aperture and a first seal surface; and a spout that is carried on, and rotatable relative to, said body and that includes at least one dispensing orifice and a second seal surface for engaging said first seal surface;

said body and spout together defining a rotary-to-linear motion translation drive system that is (1) responsive to the rotation of said spout in one direction for moving said conduit in a first direction to a closed position in which said first and second sealing surfaces are in sealing engagement to occlude said spout dispensing orifice, and (2) responsive to the rotation of said spout in the opposite direction for moving said conduit in a second direction opposite from said first direction to an open position in which said conduit first seal surface is spaced from said spout second seal surface to permit flow from said conduit discharge aperture through said spout dispensing orifice.

9. The dispensing closure system in accordance with claim 8 in which said system is a closure for an end of said container wherein the container end defines said container opening; and said closure includes said body and said spout.

10. The dispensing closure system in accordance with claim 9 in which said closure is an article that is separate from said container; and said body is removably attachable to said container end over said container opening.

11. The dispensing closure system in accordance with claim 8 in which said base includes a thread for threadingly engaging a mating thread on a container.

12. The dispensing closure system in accordance with claim 8 in which said flexible wall has a generally annular configuration which temporarily deforms as said conduit moves between said closed and open positions.

13. The dispensing closure system in accordance with claim 8 in which said spout includes a cutting edge for cutting at least partially through a sealed liner which must be breached to afford access to the container opening.

14. The dispensing closure system in accordance with claim 8 in which said conduit has (1) a generally annular wall, and (2) a central plug supported by a plurality of ribs extending radially inwardly from said annular wall whereby said at least one dispensing orifice is defined between two of said ribs, said plug, and said annular wall.

15. The dispensing closure system in accordance with claim 14 in which said first seal surface is defined on a peripheral surface region of said plug;

said conduit annular wall includes a sliding annular seal bead around said ribs, plug, and dispensing orifice; and said spout includes a skirt and an interior annular wall defining an interior surface for engaging said seal bead.

16. The dispensing closure system in accordance with claim 15 in which said plug peripheral surface region is generally cylindrical.

17. The dispensing closure system in accordance with claim 8 in which said second seal surface is a generally interior cylindrical surface.

18. The dispensing closure system in accordance with claim 8 in which said conduit includes an outwardly projecting cam follower; and said spout includes a cam track groove for receiving said cam follower.

19. The dispensing closure system in accordance with claim 8 in which said spout includes (a) a peripheral skirt, (b) a top deck defining said dispensing orifice, and (c) a collar extending from said top deck around said dispensing orifice, said collar defining said second seal orifice.

20. The dispensing closure system in accordance with claim 8 in which said base defines a peripheral lip; and said spout defines a bead for engaging said lip for holding said spout on said base to accommodate rotation of said spout relative to said base.

* * * * *